US005246234A

United States Patent [19]

Zambelli

[11] Patent Number: 5,246,234

[45] Date of Patent: Sep. 21, 1993

[54] GOLF PRACTICE AID

[76] Inventor: John L. Zambelli, P.O. Box 306, Goldsboro, N.C. 27533

[21] Appl. No.: 928,446

[22] Filed: Aug. 12, 1992

[51] Int. Cl.[5] ..... A63B 69/36

[52] U.S. Cl. ..... 273/187 R; 434/252

[58] Field of Search ..... 273/187 R, 187.1, 187 A, 273/187 B; 434/252

[56] References Cited

U.S. PATENT DOCUMENTS

| | | | |
|---|---|---|---|
| 2,150,580 | 3/1939 | Crowley | 273/187 R |
| 2,180,170 | 11/1939 | Richards | 273/187 R |
| 2,652,251 | 9/1953 | Molinar | 273/187 R |
| 3,166,327 | 1/1965 | Champion | 273/187 R |
| 4,384,718 | 5/1983 | Cachola | 273/187 R |
| 4,736,952 | 4/1988 | Taft et al. | 273/187 R |
| 5,013,044 | 5/1991 | Hesselbart | 273/187 R X |
| 5,108,106 | 4/1992 | Cook | 273/187 R |

*Primary Examiner*—George J. Marlo
*Attorney, Agent, or Firm*—Rhodes, Coats & Bennett

[57] ABSTRACT

The present invention relates to a golf practice aid for assisting a golfer in maintaining a proper stance about the golf ball and with respect to the pin or target. The golf practice aid comprises a stance quadrant, that includes an angularly adjustable elongated heel guide for defining open and closed stances. Also forming a part of the stance quadrant is an adjustable ball position indicator run that extends parallel to the heel guide. The stance quadrant is tied together by a pair of spaced apart crossties extending between the heel guide and the adjustable ball position indicator. A target support extends outwardly from the stance indicator and there is provided a movable target indicator mounted on the target support and adapted to point towards the pin or hole placement.

9 Claims, 2 Drawing Sheets

GOLF PRACTICE AID

FIELD OF INVENTION

The present invention relates to golf practicing devices and more particularly to a ground supported golf practicing device that is designed to improve a golfer's stance with respect to the position of the golf ball and with respect to the target or pin placement.

BACKGROUND OF THE INVENTION

Today, no game or sport is growing and prospering like the game of golf. New golf courses are being developed and built at a tremendous rate over the United States and the world. Participation and interest in golf is at an all time high.

Many golfers are serious about their game and are continually preoccupied with practicing and improving their game. Golfers continue to seek the assistance and advice of professional teachers and instructors such as club pros. There is no doubt that golf is not an easy game to master. No part of the game can be taken for granted or ignored. To help golfers improve their game, there are many golf practicing aids that are commercially available today. These golf practicing aids cover a wide range of areas from the "stance" to the "swing".

While various aspects or parts of the game give various golfers difficulty, probably no part of the game is of any more concern to the average developing golfer than that part of the game that revolves around his or her "stance". Proper stance is taught and practiced with all new or developing golfers and in many cases even experienced and talented golfers continue to come back to work on and improve their stance. Developing the proper stance cannot be over emphasized in teaching one to reach a high and proficient playing level in the game of golf.

It is difficult for a golf pro or golf instructor to teach and encourage the proper stance by simply asking the student or person being instructed to address the ball. The very nature of the task calls for a golf practicing aid that is designed to help position and orient the golfer to the ball and to the target. Unfortunately, there has been little work done in specifically designing a golf teaching aid that specifically addresses the "stance" problem. Therefore, there is and continues to be a need for a golf practicing aid that is particularly designed to teach the proper stance for a golfer.

SUMMARY AND OBJECTS OF THE INVENTION

The present invention comprises a lightweight portable golf practicing device that is designed to teach golfers proper alignment by teaching the golfer a proper stance with respect to the ball and the target. The present invention entails a stance quadrant that is of an elongated rectangular construction and which is designed to lie on the ground. The stance quadrant includes an adjustable back heel guide and a forward ball position indicator run. The golfer places his feet between the heel guide and the ball position indicator run. At the same time the golf practicing aid includes a target indicator assembly that projects from the rectangular stance quadrant.

In utilizing the golf practice aid of the present invention, by properly setting the teaching aid such that the target position indicator is aimed straight at the target and the ball position indicator is properly directed towards the ball then the golfer can position himself or herself within the stance quadrant such that the golfer's feet is properly positioned with respect to the ball and the target.

It is therefore an object of the present invention to provide a golf teaching aid that helps golfers learn and establish proper alignment with the ball.

A further object of the present invention is to provide a golf teaching aid in the form of a lightweight and portable accessory that can be conveniently dismantled for easy carrying.

Still a further object of the present invention is to provide a golf stance practicing aid that can be used by both left and right handed golfers.

Still a further object of the present invention resides in the provision of a golf practicing aid that corrects alignment problems that cause poor ball striking and inaccurate shots.

Another object of the present invention is to provide the golf practicing aid of the present invention with an adjustable stance guide that will enable the practicing device to be set up for a square, open or closed stance.

Still a further object of the present invention is to provide a golf practicing and teaching aid that is designed to help both the beginning and seasoned player in developing and improving their stance.

Another object of the present invention is to provide a stance teaching aid that helps the golfer visualize the target and assist the golfer in executing a proper back swing with respect to the target.

Another object of the present invention is to provide a golf practicing aid of the character referred to above that is adjustable to accommodate golfers with various size feet.

Other objects and advantages of the present invention will become apparent and obvious from a study of the following description and the accompanying drawings which are merely illustrative of such invention.

DETAILED DESCRIPTION OF THE INVENTION

Figure 1:
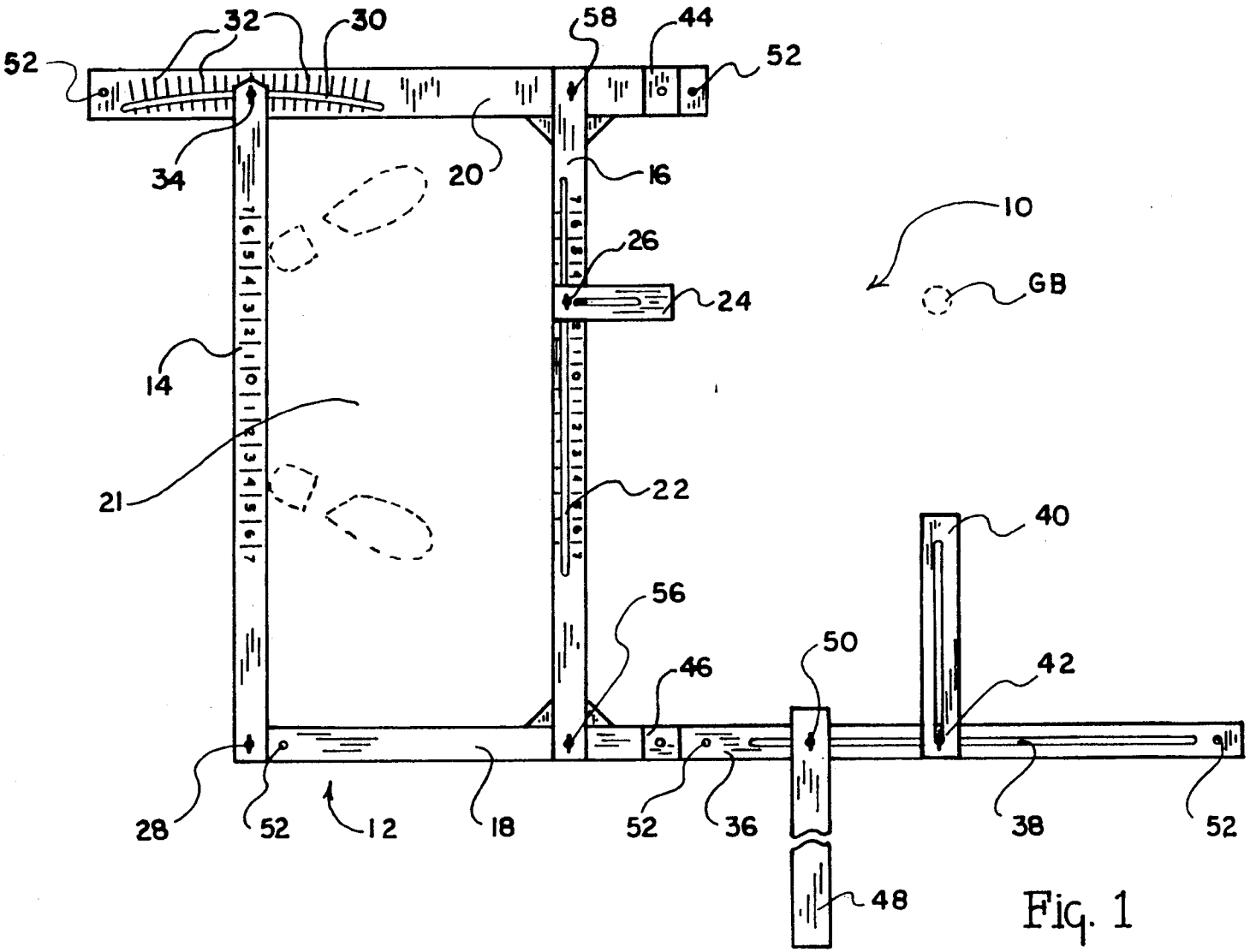
FIG. 1 is a top plan view of the golf practice aid of the present invention.

With further reference to the drawings, the golf stance practicing aid of the present invention is shown therein and indicated generally by the numeral 10.

Viewing the golf stance practicing aid 10 in more detail, it is seen that the same includes a stance quadrant indicated generally by the numeral 12. Forming a part of the stance quadrant 12 is a back heel guide 14, a ball position indicator run 16 and a pair of crossties 18 and 20. It is seen that the crossties 18 and 20 are connected between the heel guide 14 and ball position indicator run 16 so as to form a generally rectangular stance area 21 which is defined between the confines of the heel guide 14, ball position indicator run 16 and the crossties 18 and 20. As will be appreciated from subsequent portions of this disclosure, the golfer utilizing the present invention will position himself or herself within the stance area 21 while making use of this golf practicing aid.

Ball position indicator run 16 includes an elongated slot 22. A ball position indicator 24 is secured to the indicator run 16 by a wing nut assembly 26. As indicated in drawings, the ball position indicator 24 can be adjusted along the ball position indicator run 16 by moving the same back and forth between the extremities of the elongated slot 22. The ball position indicator 24 can be positioned at any desired location along the run of the elongated slot 22 by tightening the wing nut assembly 26 so as to effectively clamp or secure the ball position indicator to the ball position indicator run 16.

Turning to the heel guide 14, it will be appreciated that the heel guide 14 can be pivoted between extreme positions so as to accommodate both an open stance and a closed stance as well as a conventional square stance. In particular, note that crosstie 18 is joined with heel guide 14 through a wing nut pivot 28. Formed in an end portion of the crosstie 20 is an arcuate slot 30 that is provided with a series of graduations 32. A remote end of heel guide 14 is confined about the arcuate slot 30 by a wing nut lock 34. In particular, as viewed in FIG. 1, heel guide 14 can be rotated both clockwise and counterclockwise through the extreme range of the arcuate slot 30. This enables the golf stance practicing aid 16 to yield a guide for both a closed and open stance. In particular, by rotating heel guide 14 clockwise in FIG. 1, this gives rise to a stance area 21 that is conducive to teaching a proper closed stance. By rotating heel guide 14 from a normal parallel position counterclockwise results in a stance area 21 that is conducive to teaching an open stance.

Continuing to refer to the golf stance position aid 10, it is noted that the same includes a target support extension 36 that in the case of the present embodiment is simply an extension of crosstie 18. It is appreciated, however, that the target support extension 36 is not required to be an extension of the crosstie 18 but could be a separate or independent structure. Formed in the target support extension 36 is an elongated slot 38 that is designed to accept an adjustable target 40. Target 40 also is provided with a locking nut assembly 42 that permits the target to be anchored or stationed at any position between the extremities of the elongated slot 38.

The stance practicing aid 10 of the present invention is designed such that the stance area 21 can be increased in size from that shown in the drawings. In particular, the ball position indicator run 16 can be moved to an outward second position to effectively increase the lateral or transverse distance between heel guide 14 and ball position indicator run 16. To accomplish this, both crossties 18 and 20 include extension recesses 44 and 46 that are designed to except opposite end portions of the ball position indicator run 16. This essentially means that the ball position indicator run 16 can be moved from the position shown in FIG. 1 to an outer position where the opposite ends of ball position indicator run 16 are secured within the extension recesses 44 and 46. In this case, the stance area 21 is increased to accommodate a person with larger feet.

Figure 2:
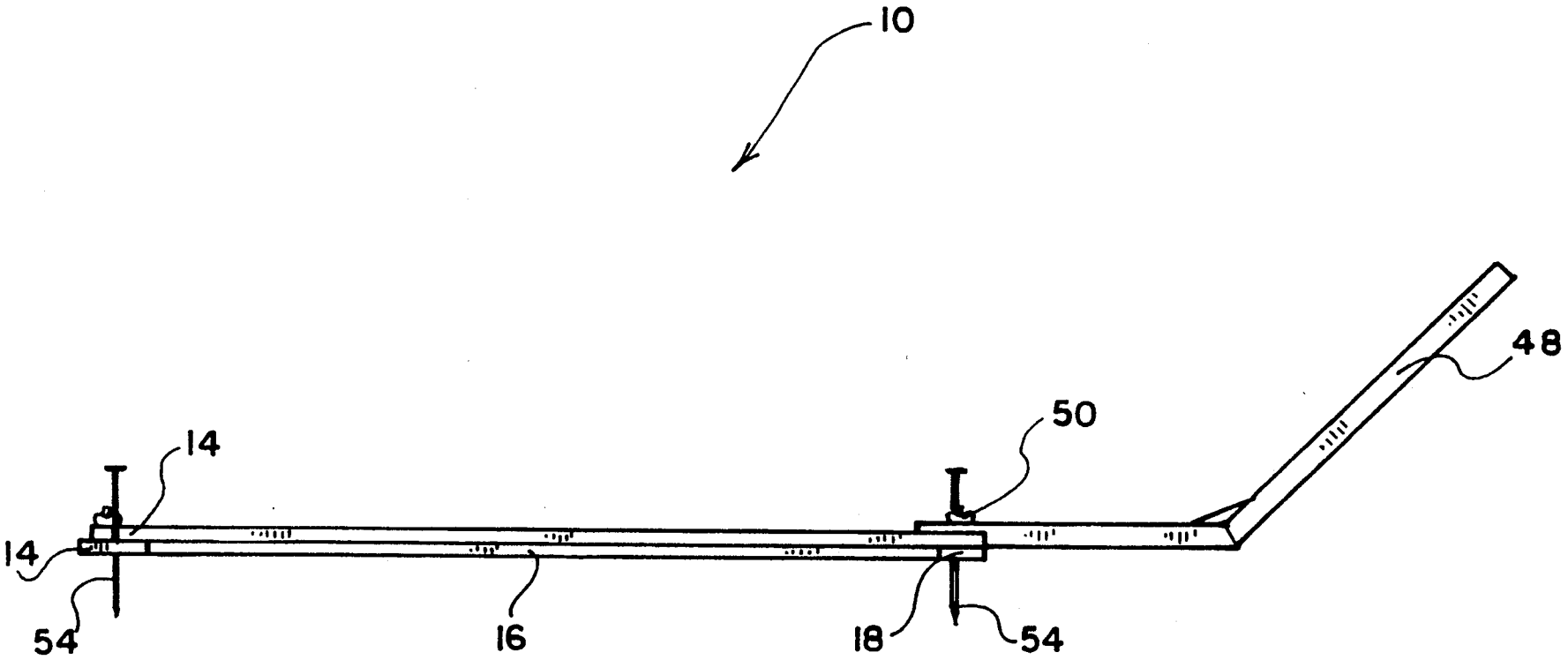
FIG. 2 is a side elevational view of the golf practice aid of the present invention.

The golf practicing aid 10 of the present invention is also provided with a handle 48 for use in moving or pushing the golf aid from one location or orientation to another. As seen in the drawings, the handle is secured within elongated slot 38 by a wing nut assembly 50. Handle 48 extends rearwardly from the target support extension 36 and as shown in FIG. 2 includes a trailing portion that is angled upwardly for convenient access.

In use, the golf practicing aid of the present invention is designed to assist a golfer in arriving at a proper stance with respect to the golf ball and the target which would typically be a pin extending upwardly from the golf hole. In any event, the golf practicing aid is positioned about the ball such that the target 40 projects through the golf ball or aligns with the golf ball. It is appreciated that the target 40 can be moved back and forth and can be anchored at a selected position to achieve this relationship. Next, the ball position indicator 24 is adjusted such that it to aligns with and points through the location of the golf ball. To secure the golf practicing aid to the ground, the same is provided with a series of spaced-apart anchor holes 52 which are adapted to receive anchor pins 54.

In order to assist in the consistent positioning of the feet within the stance area 21, both the heel guide 14 and the ball indicator run 22 is provided with numerical indicia. As seen in the drawings, the numerical indicia appearing on the ball indicator run 22 is identical to that numerical indicia appearing on the heel guide 14 and the respective numbers on each are transversely aligned so as to correspond. More particularly, and in the way of an example, the ball indicator run 22 includes a central point or area that is denoted by "0". To the right and left of the "0" point is a series of seven numerical indicia blocks. This same scheme is carried out and provided for on the heel guide 14. This enables the golfer to record the proper position of his or her heel adjacent the heel guide 14 for a particular ball position for any particular shot. In use, the instructor will record the heel settings for a particular shot and for a particular ball position on the ball indicator run 22. For example, in the case of a driver, three wood, or a four wood, the instructor might conclude that the ball should be approximately aligned with the left heel in the case of a right handed golfer. Therefore, in the case of a driver, three wood, or four wood, one can set the ball indicator 24 on "three". Then in order for the left heel to approximately align itself with the ball then the golfer's left heel (in the case of a right handed golfer) would also be disposed adjacent the "three" area on the heel guide 14. In the case of the iron shots, the proper heel position would be recorded such that the ball or the ball indicator 24 would be two to three inches inside to the left heel (for a right-handed golfer). In the case of an eight iron, nine iron or a pitching wedge shot, the proper heel position would be recorded such that the ball indicator 24 would be approximately midway between the left and right heels. It is appreciated that for each shot one has some lead way or flexibility in where the ball indicator 24 is positioned on the ball indicator run 22. However, from that point the position of the left and right heels for a particular golfer would have a fixed relationship with respect to the ball indicator 24. Therefore, each golfer would have a written schedule which would, for each shot, identify the location of the ball indicator 24 and both of the golfer's heels. Consequently, the golfer would assume the same position with respect to the ball for the same wood or iron shot time after time.

Also, it is appreciated that for different shots the spacing of the ball outwardly from the ball indicator 24 will change because the length of the respective clubs will change. Therefore, a group of club indicia marks can be placed along the target support extension 36. This indicia will identify the alignment or position of the ball with respect to the ball indicator 24 for any particular shot, that is a driver or wood shot or an iron shot. This would also be recorded on the golfer's shot schedule. Therefore, it is appreciated that the recorded golf shot schedule that is tailored for each golfer will particularly position the golfer's feet with respect to the ball for a full range of golf shots.

Appearing below is a typical position indicator card for a particular right-handed golfer.

SHOT STANCE SCHEDULE

| Shot | Ball Indicator | Left Heel | Right Heel |
|---|---|---|---|
| Driver | 5 | 6 | 5 |
| 3 Wood | 4 | 6 | 5 |
| 4 Wood | 4 | 6 | 5 |
| 2 Iron | 3 | 6 | 4 |
| 3 Iron | 3 | 6 | 4 |
| 4 Iron | 3 | 6 | 4 |
| 5 Iron | 2 | 5 | 3 |
| 6 Iron | 2 | 5 | 3 |
| 7 Iron | 2 | 5 | 3 |
| 8 Iron | 1 | 4 | 3 |
| 9 Iron | 1 | 4 | 3 |
| Pitching Wedge | 0 | 4 | 2 |

As already pointed out the golf practicing aid of the present invention is designed to accommodate both left and right handed golfers. In the case of the embodiment illustrated in the drawings, the golf teaching aid is designed to accommodate a right handed golfer. However, a left handed golfer can be accommodated by simply turning the entire golf practicing aid over to where the underside becomes the top side of the golf practicing aid. In this case, the all position indicator 24 and the target indicator can be removed from the golf practicing aid and reattached on the now top side. Likewise, heel guide 14 can be reversed by unsecuring the wing nuts 20 and 34 and resecuring the heel guide 14 to the now top side of the crossties 18 and 20. Thus, it is appreciated that the golf practicing aid 10 of the present invention can be simply turned over or reversed and with a few minor modifications can be adapted to accommodate a left handed golfer in the same way as described beforehand in the case of the right handed golfer.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A golf practice aid for assisting one in maintaining a proper stance relative to ball replacement and a target comprising:

a) a stance quadrant including an elongated heel guide, a ball position indicator run extending parallel to the heel guide, an adjustable ball position indicator movably mounted for back and forth movement on the ball position indicator run, and a pair of spaced apart cross ties extending between the heel guide and the ball position indicator run to form an enclosed stance area for receiving the golfer and confining the feet of the golfer within the formed quadrant;

b) a target support extending outwardly from the stance quadrant;

c) a target indicator mounted on the target support and adapted to point towards a pin or hole placement;

d) and means for slidably adjusting the heel guide along a portion of one of said cross ties for angling the elongated heel guide relative to the ball position indicator so as to define a series of stances including both open and closed stances.

2. The golf practice aid of claim 1 wherein the heel guide is pivotally mounted to the stance quadrant such that it can be moved back and forth to accommodate either an open or closed stance.

3. The golf practice aid of claim 2 wherein the heel guide includes a movable end portion that is confined within an arcuate adjustment slot formed in one of the cross ties, and wherein the heel guide includes an opposite end portion that is provided with means for pivotally mounting the heel guide to the stance quadrant such that the same can be pivoted back and forth to accommodate various degrees of both open and closed stances.

4. The golf practice aid of claim 1 wherein the target support includes an elongated adjustment slot formed therein and wherein the target indicator includes means for adjustably securing the target indicator at various positions within the elongated slot formed in the target support.

5. The golf practice aid of claim 1 wherein the same is reversible such that it can be used by both left and right-handers.

6. The golf practice aid of claim 1 including means for staking and securing the golf practice aid to the ground.

7. The golf practice aid of claim 1 including means to expand the stance quadrant so as to vary the confined stance area.

8. The golf practice aid of claim 1 including establishing a selected relationship between the position of the ball and the position of the golfer's heels with respect to the ball.

9. The golf practice aid of claim 9 wherein the indicia means include a series of indicia formed on both the ball position indicator run and the heel guide.

* * * * *